United States Patent [19]

Petersen

[11] 4,122,437

[45] Oct. 24, 1978

[54] INTRUSION ALARM CONTROL SYSTEM

[75] Inventor: Christian C. Petersen, Westwood, Mass.

[73] Assignee: Cegg, Inc., Boston, Mass.

[21] Appl. No.: 750,667

[22] Filed: Dec. 15, 1976

Related U.S. Application Data

[63] Continuation-in-part of Ser. No. 554,717, Mar. 3, 1975, Pat. No. 4,012,611.

[51] Int. Cl.[2] ..... G08B 13/02

[52] U.S. Cl. ..... 340/528; 340/566; 340/384 E

[58] Field of Search ..... 340/261, 283, 384 E, 340/274 R

[56] References Cited

U.S. PATENT DOCUMENTS

| | | | |
|---|---|---|---|
| 3,803,576 | 4/1974 | Dobrzanski et al. | 340/274 R |
| 3,905,016 | 9/1975 | Peterson | 340/384 E |

*Primary Examiner*—Glen R. Swann, III

[57] ABSTRACT

An intrusion alarm system of a variety utilizing an inertially responsive sensor preferably present as a pendulum actuated reed switch. Logic circuits provided within the system provide, in one embodiment, an efficient pulsating alarm at dual frequencies optimized for human recognition. In another arrangement, a unique dual delay arrangement is provided, one delay commencing with the arming of the device to permit adequate time for the setting of a sensing switch. A second delay arrangement is provided at the option of the operator for purposes of delaying the activation of the alarm once the sensor switch has been tripped. This feature may be utilized to permit entrance through a door or the like upon which the unit is mounted wherein the device can be deactivated prior to assuming an alarm sounding condition. In each of the circuit embodiments, an arrangement is provided wherein, once tripped, the alarm will continue to sound for designated intervals even though turned "off".

10 Claims, 6 Drawing Figures

| | OPERATIONAL EVENT | GATE 80 LINE | | | GATE 78 LINE | | | GATE 76 LINE | | | GATE 74 LINE | | |
|---|---|---|---|---|---|---|---|---|---|---|---|---|---|
| | | 110 | 127 | 120 | 120 | 122 | 124 | 168 | 125 | 140 | 140 | 142 | 90 |
| 1 | SW 90 OPEN | 0 | 1 | 1 | 1 | 1 | 0 | 0 | 0 | 1 | 1 | 1 | 0 |
| 2 | SW 90 CLOSED ARM DELAY | 0 | 1 | 1 | 1 | 1 | 0 | 0 | 0 | 1 | 1 | 1 | 0 |
| 3 | ARM DELAY TERMINATION | 1 | 1 | 0 | 0 | 0 | 1 | 0 | 1 | 1 | 1 | 1 | 0 |
| 4 | ARM STATE B | 1 | 0 | 1 | 1 | 1 | 0 | 0 | 0 | 1 | 1 | 1 | 0 |
| 5 | ARM STATE A | 1 | 1 | 0 | 0 | 0 | 1 | 0 | 1 | 1 | 1 | 1 | 0 |
| 6 | SW 96 CLOSES AT STATE A | 1 | 1 | 0 | 0 | 0 | 1 | 1 | 1 | 0 | 0 | 0 | 1 |
| 7 | NET 62 OSC. DURING ARM STATE. A | 1 | 1 | 0 | 0 | 0 | 1 | 1 | 1 ↕ 0 | 0 ↕ 1 | 0 ↕ 1 | 0 ↕ 1 | 1 ↕ 0 |
| 8 | SW 90 OPENS ALARM ON | 1 | 1 | 0 | 0 | 0 | 1 | 1 | 1 ↕ 0 | 0 ↕ 1 | 0 ↕ 1 | 0 ↕ 1 | 1 ↕ 0 |
| 9 | TERMINATION OF ALARM ON DELAY PERIOD | 0 | 1 | 1 | 1 | 1 | 0 | 0 | 0 | 1 | 1 | 1 | 0 |

FIG. 5

INTRUSION ALARM CONTROL SYSTEM

RELATED APPLICATIONS

The present invention is a continuation-in-part of application for U.S. patent Ser. No. 554,717 filed Mar. 3, 1975 now U.S. Pat. No. 4,012,611.

BACKGROUND

Intrusion alarm systems have been devised under a broad number of schemes ranging from a dog that barks to ultra sophisticated systems designed for the protection of highly valuable property and produced at commensurate cost. When developing any of the intrusion alarm systems, the design approach generally is premised upon a need to apprise one entity of the passage and, preferably, attempted passage of another entity across a selected portal or vulnerable boundary.

The effectiveness of alarm designs has, to the present, been predicated upon the degree of sophistication, redundancy and/or number of separate components for the system contemplated. As alarm system designs have evolved for broadened, higher volume markets, their sophistication has given way to the extent that the sensing techniques utilized tend toward either the primitive or specialized-monofunctional and the logic of alarm control is reduced to affording the operator only few alternatives, i.e., the devices are more readily compromised. For instance, intrusion alarm devices intended for the relatively higher volume, popularly priced market have been seen to utilize simple switches mounted on the inside of a door to detect a successful unauthorized entry. Such sensing does not enjoy the capability for detecting and alerting to an attempted entry. For such a function, sensing components must be capable of exhibiting a very high degree of sensitivity to minor impact or similarly generated phenomena. Where an alarm is sounded at a mere attempted entry, the occupant within the area of alert is afforded the most valuable of surveillance service — the maximum available time interval to react to undertake protective measures.

To remain practical for higher volume markets, all such sensing devices should be easily calibrated to accommodate for an obviously broad range of sensing conditions. For instance, environmental "noise" conditions such as vibration and the like must be easily accounted for.

To simplify gaining access through a door protected by a simplified alarm, resort often is made to designs permitting an alarm delay following the triggering thereof. Thus the operator may enter an alarm supervised door and, within the delay interval, disarm the alarm by throwing an arm switch or the like. To be effective in this form, the delay period must be relatively short and the resetting technique should be relatively difficult to ascertain by anyone but the operator.

Coded entrance arrangements heretofore have been proposed wherein a switching code or key system is mounted at the outer side of a protected door and which, when properly actuated, remotely disarm an alarm system. Such systems, however, generally are too complex for manufacture and installation under high volume procedures suited to achieve popular price levels. For instance, the devices may be required to be mounted and wired within a wall. Alternately, complexities are encountered in protecting otherwise exposed wiring extending from one side of a door to another.

Another aspect to be considered in providing a practical alarm system suited for popular utilization resides in the degree of installation expertise required of the purchaser. A most advantageous system is one which requires no mounting or assembly expertise whotsoever; for instance, no wiring or sensor switch installation, and equally simple access accessory installation.

SUMMARY

The present invention is addressed to a unique intrusion alarm sensing arrangement and system. Suited for a broad range of applications within the popularly priced market, the alarm system, including power supply, sensor, alarm and logic circuitry conveniently may be incorporated within a relatively small, lightweight singular housing readily mounted upon a door or portal selected for surveilance.

The sensor of the system responds inertially to an impact or motion generating phenomena imparted to the housing and is adjustable to exhibit a sensitivity which, for many installations, will react to a mere attempt at unauthorized entry. In its preferred embodyment, the sensor is formed including a body of predetermined mass suspended in pendulum-like fashion upon a rod or the like from a fixed point within the housing. However, other mounting arrangements for the mass are contemplated within the scope of the invention. A switch arrangement including a magnetically actuable switch and a magnet is mounted with respect to the end portion of the rod and a fixed, null location upon the housing. Any relative movement between these components will trip the system to sound an alarm. Preferably, a bar-type permanent magnet is fixed to the rod terminus, while a magnetically actuated reed relay switch is fixed to the housing.

Through the use of a switch arrangement incorporating a reed relay switch, a region of higher ferrous metal mass derived from overlapping switch contacts is provided on the housing toward which region the pendulum suspended magnet will automatically tend to null. This feature provides for convenient arming procedures and operation.

Another feature and object of the invention is to provide an alarm system including first and second oscillator networks, the first of which provides an output signal at a first frequency selected for optimum lower frequency human recognition. The second oscillator network provides an output at a second higher frequency, again selected for optimum human recognition. Activation of the second network serves to drive an alarm-transducer device at the second frequency and is dependent upon the derivation of a signal from the sensor as well as the presence of a select output condition of the first oscillator network. Accordingly, a pulsating "on and off" alarm is sounded at optimized first and second frequencies. With the system, the sensor signal need only be transient.

As another feature, the system provides a delay arrangement which responds to the actuation of a system arm or enable switch. Operative in conjunction with the input stage of the noted first oscillator network, this feature provides an initial delay to permit the sensor to attain a null after arming, as well as to assure continued alarm activation for a predetermined interval following system firing.

Another feature of the invention provides with the noted second oscillator circuit an arrangement for detecting a transient sensor signal condition and retaining a select second network input for a short predetermined interval.

Another feature and object of the invention is to provide an alarm system providing not only the above-noted delay arrangement responding to the actuation of the enable or alarm switch to permit stabilization of the sensor, but also a timing arrangement wherein the alarm will not sound for a given short interval following the activation of the sensor. Should the reset switch of the system be actuated within that interval, the entire system will reset itself. Such system also provides for an operator selection for inserting such alarm delay or for providing operation wherein the alarm is activated simultaneously with the actuation of the sensor. Such an arrangement facilitates the use of the device wherein remote disarm arrangements are not available and reset access to the system must be had through the portal upon which the alarm system is mounted.

As another feature and object, the invention provides a remote disarm arrangement for the system requiring no external wiring and utilizing a simple permanent magnet.

Other objects of the invention will in part be obvious and will in part appear hereinafter.

The invention, accordingly, comprises the system and apparatus possessing the construction, combination of elements and arrangement of parts which are exemplified in the following detailed disclosure.

For a fuller understanding of the nature and objects of the invention, reference should be had to the following detailed description taken in conjunction with the accompanying drawings.

BRIEF DESCRIPTION OF THE DRAWINGS

FIG. 5 is a truth table showing the performance of various components of FIG. 4 in the course of a series of operational events of the system.

DETAILED DESCRIPTION

The basic unit of the intrusion alarm system of the invention is housed in a small, compactly structured container so dimensioned as to be conveniently attached to a portal intended for surveillance, i.e., a door, window or the like. This unit contains an inertially reactive sensing device, logic circuitry, alarm and power supply. Where desired, it may be combined with an entrance arrangement to permit subsequent externally devised access through an activated alarm guarded portal or door by utilization of a magnetic disarming technique.

Figure 1:
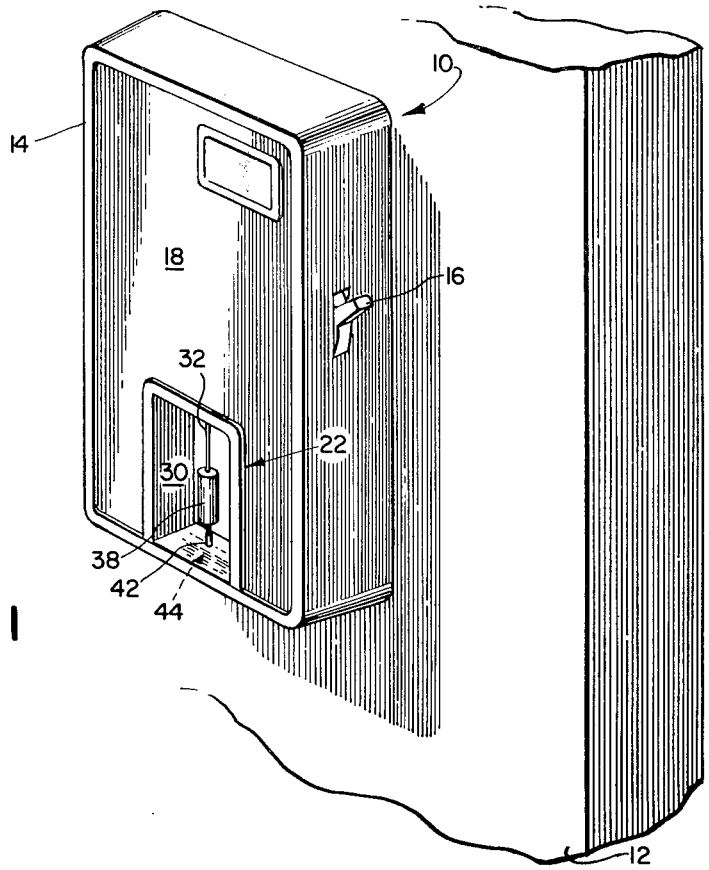
FIG. 1 is a perspective view of the basic alarm system unit of the invention as it is mounted upon a door.
Figure 4:
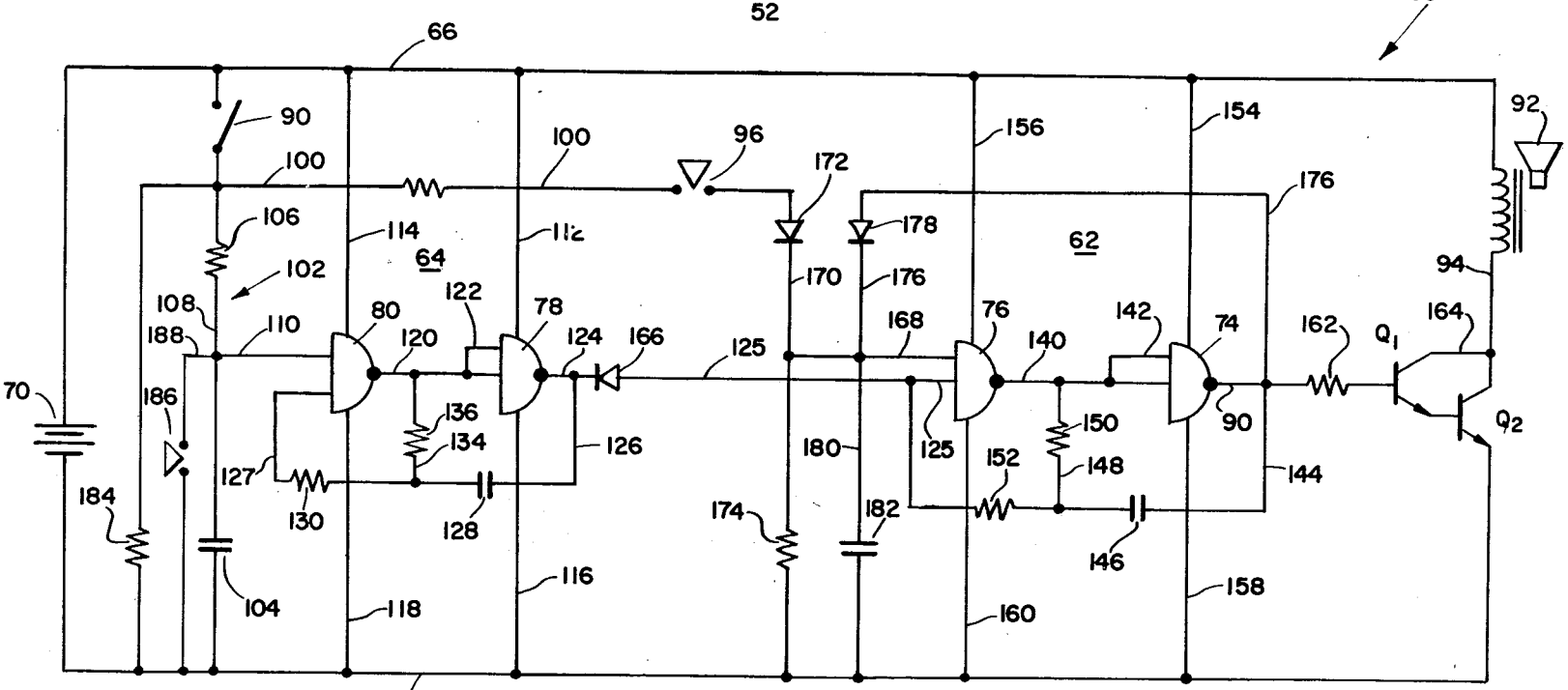
FIG. 4 is a schematic drawing of the logic circuit of one embodiment of the invention.

Looking to FIG. 1, the basic intrusion alarm unit is revealed generally at 10 as it may be mounted, for example, upon a door 12. Unit 10 includes a box-like outer container 14, the rearward face of which is secured to an interior surface of door 12. Inasmuch as unit 10 may be fabricated of very light but sturdy materials, i.e., plastic, attachment to the door 12 may be conveniently provided by such materials as dual adhesively faced tape or the like positioned intermediate the rear surface of the unit and the door surface. In addition to integrated logic and alarm circuitry and, preferably, a typical primary battery power supply, container 14 supports an arm switch 16, a loudspeaker, for the embodiment of FIG. 4, located within the unit for broadcast through surface area 18 thereof, and an inertially responsive sensor assembly, represented at 22. In general, the basic alarm unit 10 performs as follows: Upon positioning unit 10 at a location for detecting vibration, impact, accellerative motion or the like, for instance, upon the inside face of door 12, the operator throws arm or enable switch 16, which serves to activate an alarm-logic circuit only following a predetermined interval, for instance, 40 seconds. That arming interval permits any motion imparted to appropriate components of sensor assembly 22 during the arming procedure to be damped so as to gain a quiescent, null condition without tripping the alarm. This interval also will permit the operator to leave the area under surveillance through the door 12 upon which the unit 10 is mounted without causing it to prematurely trip. A slight motion or impact imparted to unit 10 from door 12 subsequent to the arming interval will activate the sensing system of the device to sound a loud pulsating alarm. In the embodiment of FIG. 4, after having been set off, the pulsating alarm can be turned off only following a predetermined interval, for instance, 60 seconds, from the throwing of arm or enable switch 16 to its initial off or disarm orientation. Should the sensing arrangement of the device not have been tripped, so throwing switch 16 to an off orientation will immediately deactivate the system.

The self-contained sensing arrangement 22 of the alarm system enjoys a particularly advantageous feature. For instance, through its inertially based performance, it is able to sense a very light impulse, thus being capable, in many instances, of forewarning the user thereof of a mere attempt at unauthorized entry. As a consequence, a highly valuable interval for protective reaction is availed the user. This feature is available, while, importantly, the sensitivity of the assembly 22 remains adjustable to accommodate for spurious vibration or motion, i.e. "noise", which otherwise might occasion false alarms. Another important aspect of the sensor assembly 22 resides in its incorporation within unit 10, i.e., small, compact unit 10 is an entirely self-contained alarm system with no externally positioned components.

Figure 2:
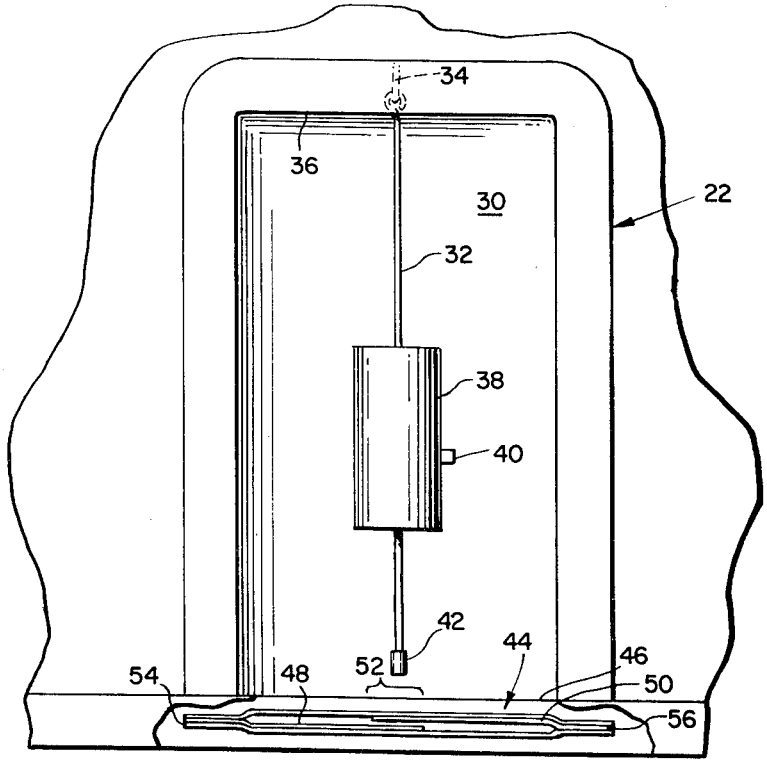
FIG. 2 is a fragmentary front view of the sensor arrangement of the invention.

Looking to FIG. 2, sensor assembly 22 is revealed in more detail as it is oriented in a null or quiescent status. The assembly is formed within a compartment or the like 30 of container 14 and includes a rod or suitable support 32 which is pivotally suspended therein. In this regard, the upper end of rod 32 is formed as a hook or the like and provides freely swinging pivotal attachment with a U-shaped connector 34 fixed within top wall 36 of compartment 30. Slideably mounted upon rod 32 is a body of predetermined mass present as a centrally bored cylinder 38 fashioned of any suitable stock material, for instance, aluminum, brass, or the like. Cylinder shaped mass 38 is radially bored and tapped to receive a set screw 40 which may be tightened against rod 32. With this arrangement, mass 38 may be positioned at any desired location along rod 32 and the assembly, thus far described, may be observed to represent a pendulum.

To the opposite, lower end of rod 32 is attached a small, somewhat cylindrically shaped, vertically oriented bar type permanent magnet 42. Magnet 42, thus suspended for movement in conjunction with rod 32, is located such that its lower polar end is situated a given, relatively slight distance above a conventional magnetic reed switch 44. Switches as at 44 typically include a sealed tubular glass envelope 46 supporting therewithin, in cantilever fashion, two oppositely disposed, parallel and mutually spaced metal switch contacts as at 48 and 50. Present as low reluctance, ferromagnetic, slender flattened reeds, these contacts are oriented to overlap in spaced mutual relationship defining a small air gap at a centrally disposed region 52 of switch 44. Accordingly, when caused to close or join, contacts 48 and 50 complete an electrical circuit through leads as at 54 and 56. Closure is carried out by causing contacts 48 and 50 to assume opposed magnetic polar states, i.e., north and south. In the presence of sufficient flux density, the attraction forces of the opposing magnetic poles overcome the reed stiffness causing them to flex toward each other to make contact.

Figure 3:
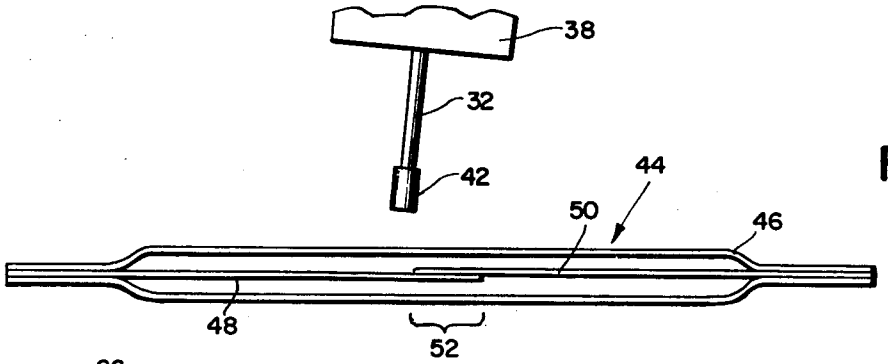
FIG. 3 is an enlarged partial schematic view of portions of the sensor arrangement of the invention.

As may be evidenced from the drawing, contacts 48 and 50 uniquely are separated to define an open circuit when vertical magnet 42 is oriented, as shown, directly over region 52. This mutual identically polarized condition of the contacts providing for their open circuit orientation is occasioned by the relatively close proximity of only one, the lower, pole of magnet 42 to the ferrous metal mass represented by those end or overlapping portions of the contacts within region 52. In the presence of an actuating impulse or movement, the orientation of magnet 42 with respect to switch region 52 is altered, for instance, to the orientation represented in FIG. 3. Here, the magnetic flux influence upon switch 44 alters to establish opposing magnetic poles at the respective end portions of contacts 48 and 50 within region 52. As a consequence, the switch rapidly reacts to close as illustrated.

In general, the above-described actuating alteration of the open contact condition of switch 44 is occasioned by a relative motion of the switch itself with respect to magnet 42. This relative movement results from an inertial tendency of the body of mass 38, and, consequently, magnet 42 to remain at rest while impulse generated motion is imparted to switch 44. Note in this regard, that switch 44 is fixed with respect to compartment 30 which, in turn, is fixed within container 14, fixedly attached, in turn, to door 12 (FIG. 1). Of course, following the above-detailed rapid initial switch actuation, rod 32 will tend to swing, thereby causing subsequent additional switch actuations. As is described in detail hereinafter, the initial actuation of switch 44 will cause the setting off of an alarm.

The sensitivity of the sensor arrangement ahown is advantageously and simply adjustable by the operator. For example, a lower sensitivity may be provided by raising cylindrical mass 38 upon rod 32. Conversely, higher degrees of sensitivity are effected by simply lowering mass 38 to a selected position closer to magnet 42. Such adjustments may be provided, for instance, to accommodate the alarm device to function properly in the presence of environmental vibrations or the like which otherwise might occasion false alarms.

In addition to a uniquely responsive alarm switching or tripping function being provided by the above-described inertial sensing arrangement, an important, additional operational function is achieved. The overlapping portions of contacts 48 and 50 at region 52 constitute a region of relatively higher ferrous metal mass. Accordingly, vertically oriented magnet 42 is continually biased to orient itself over that region, in effect, a null point being developed thereat. Once the rod 32-magnet 42 assembly is disturbed to assume a swinging motion, it will tend to self-null at region 52. In consequence of this nulling reaction, sensor 44 will reset itself within an advantageously shorter interval and impart a valuable stability to the sensing system. As a further advantage, the entire basic unit 10 may be mounted upon a door 12 or the like with greater ease. The requisite null orientation of the rod 32-magnet 42 assembly will be effected without recourse to elaborate alignment procedures during the mounting of unit 10. For instance, a minor misalignment on the part of the operator is acceptable due to the attraction between the lower pole of magnet 42 and the ferrous metal mass at region 52.

The inertial sensing arrangement of the invention may assume a variety of configurations, however, that preferred has been described above in connection with FIGS. 1–3. As an example of another configuration, rod 32 may be formed of a resilient material, i.e., piano wire or the like, and fixedly mounted to a wall of the unit housing in cantilever fashion. As in the preferred embodyment, a permanent bar magnet would be attached to the free end of such rod so as to be juxtaposed to a region as at 52 of a reed or suitable magnetically actuated switch. Additionally, such switch may be mounted upon the rod 32 or the like, while the magnet is fixed to the unit housing.

Turning to FIG. 4, a circuit intended for incorporation within unit 10 and operable in complement with sensor assembly 22 is revealed. Shown generally at 60, this circuit includes two oscillator networks 62 and 64 coupled between principal power leads 66 and 68, a battery power supply 70 and a PM speaker 92. Networks 62 and 64 incorporate four NAND gate components 74, 76, 78 and 80, for example, of a COS/MOS variety. As such, the gates exhibit very little power drain when the circuit is in a quiescent state to permit the utilization of small, compact conventional primary batteries as power source 70 for reasonably lengthy service intervals. FIG. 5 is a truth table provided to more clearly illustrate the performance of these components, Boolean enumeration being utilized to designate their operational states. For purposes of understanding these tabulations, as well as to facilitate the description to follow, when the inputs or outputs of identified components are at a ground or appropriately pass a corresponding reference potential, they are referred to as "low" and, additionally, such input or output may be digitally identified as "0". Conversely, when these inputs or outputs assume or approach the voltage status of the power supply, they are referred to as being "high" and are given the binary designation "1". NAND logic, as utilized herein, requires the presence of a 1 level at all inputs to a given gate to derive an 0 output level. Any combination of 0's or 0 and 1 at a NAND gate input will provide a 1 level output.

Other components of the circuit mentioned earlier herein include the arm switch 16, now represented by switch symbol 90, PM loudspeaker 92 located between lines 66 and 94, and sensor switch 96 within line 100 representing reed switch 44 described earlier herein.

With the closure of arm switch 90, the enabling logic of the circuit is activated by the energization of line 100.

Such energization activates an R-C timing network 102 including timing capacitor 104 and timing resistor 106, appropriately located within line 108 between lines 100 and 68. Line 108 of network 102 is coupled, from a point intermediate resistor 106 and capacitor 104, to input line 110 of gate 80. Accordingly, with the arrangement shown, input line 110 is maintained at a low state both prior to the closure of switch 90 and during the timing interval determined by the time constant of network 102. Components 104 and 106 are selected to establish the above-described arming delay interval permitting sensor assembly 22 to achieve a null or quiescent condition. This interval may be selected, for example, as about 40 seconds. Prior to the noted closure of switch 90, as well as during the above-described "arm delay" interval, the states of appropriate input and output lines for gates 74–80 are listed in FIG. 5 at those lines designated "Operational Event" Numbers 1 and 2. It will become apparent as the description unfolds that any opening or closing of sensor switch 96 during these operational events will not occasion a tripping of the alarm device and consequent activation of loudspeaker 92.

As is depicted in FIG. 5, upon the occurrance of Operational Event No. 3, at the termination of the arm delay interval, input line 110 reaches a high logic level serving the purpose of arming the control system by activating oscillator network 64. NAND gates 78 and 80 of network 64 are linked to provide an astable multivibrator circuit having a sub-audio range output frequency selected to derive the pulsating, on and off, alarm feature of the system. Such pulsation frequency serves to maximize operator response to an alarm and may, for example, be selected in the 1–5 cycles-per-second range. A 4–5 C.P.S. range is preferred to achieve peak human audio response. Gates 78 and 80 are coupled for power input from principal lead 66, respectively, through lines 112 and 114, and are connected with principal lead 68, respectively, through lines 116 and 118. The output of gate 80 is coupled through lines 120 and 122 to each of the two inputs of gate 78, while the output at line 124 of gate 78 is connected through line 126, capacitor 128 and a stabilizing resistor 130 to the second input of gate 80. The coupling of resistor 130 with the noted gate 80 input is represented by the number 127 to facilitate the description to follow. A line 134, incorporating resistor 136, connects output line 120 with one side of capacitor 128 through line 126. Network 64 thus being configured, the arm condition high input to gate 80 at line 110 and corresponding high input at line 127, as disclosed at Operational Event No. 3, causes output line 120 to assume a low state. The consequent dual low input through lines 120 and 122 to gate 78 provides the noted high output thereof at line 124. Note that the voltage at the junction of lines 126 and 134 is now at its most positive value with respect to line 68, i.e., ground. Resistor 136, serving as a timing resistor in conjunction with capacitor 128, is connected through the output of gate 80 which is low, to provide a path to ground, i.e., through line 118. As capacitor 128 discharges, the voltage at the junction of lines 126 and 134 approaches and passes through the transfer-voltage point of gate 80. At the instant that this crossover occurs, the output of gate 80 at line 120 becomes high; as a result, the output at line 124 of gate 78 becomes low and capacitor 128 now is charged in the reverse direction. Note that the voltage at the junction of lines 126 and 134 is now at its most negative value with respect to line 68 (ground). This activity is represented as Operational Event No. 4 (Arm State B) of FIG. 5. Resistor 136, connected to the output of gate 80, now provides a path to charge capacitor 128 through line 114. Capacitor 128 begins to charge to this voltage. Again, the voltage approaches and passes through the transfer-voltage point of gate 80. At that instant, the outputs of gates 78 and 80 revert, output line 120 becoming low and output line 124 becoming high. The consequence of this oscillation is represented at Operational Event No. 5 (Arm State A) in FIG. 5. Without further signal or logic input, the Arm State A (Operational Event No. 4) — Arm State B (Operational Event No. 5) cycle repeats at the described lower frequency. Note that capacitor 128 also is coupled through stabilizing resistor 130 to an input of gate 80. This resistor, participating in the alteration of logic levels at line 124, reduces the variations of the frequency of oscillation of network 64 that normally would occur with supply voltage variation.

By utilizing, for instance, COS/MOS integrated circuit components within networks 64 and 62, the power drain of the system is very low, i.e., in the microwatt range as long as the output of gate 74 at line 90 remains low.

Oscillator Network 62 is formed having the same general configuration as network 64. For instance, the output at line 140 of NAND gate 76 is coupled in combination with line 142 to the inputs of NAND gate 74. Additionally, the output at line 90 of gate 74 is connected through line 144, capacitor 146, line 148 and resistor 150 to line 140. Line 144 further connects capacitor 146 to gate 76 input line 125 through a stabilizing resistor 152. Connection of gates 74 and 76 with power lead 66 is provided, respectively, by lines 154 and 156, while corresponding connection with lead 68 is provided, respectively, by lines 158 and 160. While operating in essentially the same fashion as network 64, the astable multivibrator circuit of network 62 provides an oscillatory output at line 90 selected to operate PM loudspeaker 92 at a frequency effecting peak human audio response. This frequency, determined by the resistance and capacitance, respectively, of resistor 150 and capacitor 146, preferably is selected between 1 to 4 $KH_z$.

Control over the operation of loudspeaker 92 is derived from output line 90 of gate 74 which is connected through resistor 162 to the base of the input transistor $Q_1$, of Darlington paired NPN transistors $Q_1$ and $Q_2$. Note that the collector of transistor $Q_1$ is connected through line 164 to line 94, while that of transistor $Q_2$ is directly coupled to line 94. The emitter of transistor $Q_1$ is coupled to the base of transistor $Q_2$, while the emitter of the latter is connected to lead 68. Thus configured, with the presence of a high at line 90, transistors $Q_1$ and $Q_2$ are forwardly biased to turn on and energize loudspeaker 94. Such energizations, as discussed above, will occur at the selected frequency of the output at line 90 of Network 62. Additionally, this higher frequency output will be present at the overriding frequency interval derived at the output of network 64. Accordingly, a desired on and off warning arrangement is provided for alerting the operator.

It should be observed that the control system provides an alarm signal at two frequencies, each selected in accordance with the invention, to provide maximized human audio recognition, i.e. the output frequency of network 64 is selected for lower frequency peak recognition while the output of network 62 is selected for higher frequency peak recognition.

Looking now to the operational association between networks 62 and 64, note that lines 124 and 125 connect the output of gate 78 through steering diode 166 to an input of gate 76. This input to gate 76 will be seen to be low when the output of gate 78 is low and will otherwise retain the state "high or low" associated with the condition of network 62. The other input to gate 76 is present at line 168 which, in turn, is coupled through line 170 and diode 172 to sensor switch 96 and to lead 68 through resistor 174. Line 168 also is coupled with a line 176, incorporating a diode 178 and extending to output line 90. Oppositely disposed from line 176 and coupled between line 168 and lead 68 is a line 180 incorporating a capacitor 182.

Actuation of network 62 to effect the driving of loudspeaker 92 will depend upon the simultaneous logic states at lines 168 and 125. Assuming that the system is armed, network 64 will be in a low frequency oscillatory mode, as described above in connection with Operational Event Numbers 4 and 5. During the armed condition of the system, as represented by "Arm States" A and B, the output line 140 of gate 76 is maintained in a high status to, in turn, maintain a low output at line 90 of gate 74. This is occasioned by the arrangement wherein line 168 is maintained at a low value, particularly, by virtue of its coupling through line 170 and resistor 174 to ground potential lead 68. During this system condition, input line 125 may vary between high and low values. Note for instance, that the high value at line 140 is introduced through resistor 150 and line 148 as well as resistor 152 to line 125. Resistor 152 is selected having a significantly higher value of resistance than that of resistor 150 and the resistance to ground of gate 78 when in a low condition. When line 124 is at a low state, line 125 will follow it, inasmuch as the gate-to-ground impedance at gate 78 is of much lower value than that at resistor 152. Conversely, when the output at line 124 of gate 78 is high, diode 166 is back-biased and the resultant high value present at lines 140 and 148 is imposed at line 125 through resistor 152. Accordingly, output line 140 is maintained at a necessary high state during this armed period of operation.

Should sensing switch 96 close under the Arm State A gate status represented by Operational Event No. 5, current will be permitted to flow through line 100, diode 172, lines 170, 168 and 180 to charge a capacitor 182. Such charging takes place very rapidly, for instance, within an interval of 0.2 ms., to establish a high state at input line 168. Inasmuch as line 125 is at a high level, output line 140 of gate 76 becomes low. In turn, the output at line 90 of gate 74 becomes high to turn on the Darlington connected transistors $Q_1$ and $Q_2$, thereby initially activating loudspeaker 92. Assuming that switch 96 opens very rapidly following initial closure, the high value at line 168 will be maintained by virtue of the time interval required to otherwise discharge capacitor 182 through lines 180, 168, 170 and resistor 174. This interval of maintaining the high status at line 168 continues for a period of time sufficient for output line 124 of gate 78 to regain a high value from a previous oscillative low and, therefore, a high value at line 125. Note that the condition of gate inputs and outputs at the point of actuation of switch 96 is represented as Operational Event No. 6 in FIG. 5.

As is apparent, oscillation of network 62 takes place only during Arm State A, as represented at Operational Event No. 5.

Looking to Operational Event No. 7, the state of the gates of the circuit are represented during an oscillation of network 62 to effect actuation of loudspeaker 92. The development of a high level at output line 90 of gate 74 is returned via line 176 and diode 178 to re-establish a charge at capacitor 182 and, in effect, hold a high state at input line 168. Accordingly, even though sensor switch 96 may be opened, network 62 will continue to oscillate. Note in this regard, that input line 125 will oscillate between high and low states in the same fashion as described in connection with line 127 of network 64. This oscillation of network 62 continues as long as Arm State A is present. Upon return of the circuit to Arm State B, as dictated by the oscillative frequency of network 64, line 125 will return to a low value to, in turn, return output 90 to a low state, thereby switching off Darlington connected transistors $Q_1$ and $Q_2$. Loudspeaker 92 is held off for the pulse interval established by network 64. Of course, upon a return of the system to Arm State A, network 62 again will commense to oscillate at the higher frequency value. It may be observed from the foregoing that sensor switch 96 need be closed only for a very short interval of time to trigger the system into an alarm state. No sensor switch tending techniques utilizing SCR clamping arrangements or the like are required.

As described earlier, should arm switch 90 be opened in the course of operation of the alarm, i.e. during the pulsating drive of loudspeaker 92, the input and output logic of the gates of the circuit will assume the states depicted at Operational Event No. 8. Note from that event number, that initial opening of the switch 90 will have no effect upon the input and output states of the gates of the circuit. This condition obtains since capacitor 104, being charged, will hold input line 110 at a high state until such time as it is discharged through resistors 106 and 184. This discharge takes place over a selected interval, for instance, about one minute, at the termination of which the transition level at line 110 drops to establish a low value. In consequence, network 64 is shut down to, in turn, effect a shutting down of network 62 to terminate alarm activity. The state of the inputs and outputs of the gates for this condition is represented at Operational Event No. 9 in FIG. 5. Turning now to a normal shutdown operation, arm switch 90 most frequently will be opened under conditions of either Arm States A or B, and prior to any closure of sensor switch 96. Upon such switch 90 opening, line 100 immediately will drop to a voltage value established by the ratio of the resistances of resistors 106 and 184. In this regard, the resistance value for resistor 106 is selected as being higher than that of resistor 184 to the extent that, upon an opening of switch 90, line 100 assumes an effective low value. As is apparent, it is now impossible to obtain a high value at line 168 even with a closure of sensor switch 96. Therefore, initiation of oscillation of network 62 is prevented.

An externally derived disarming technique is available for the circuit of the invention. For instance, a disarming arrangement requiring only a momentary actuating operation is represented by a switch 186 present within line 188 between line 110 and lead 68. Upon momentary closure of switch 186, line 110 will assume a low state to, in turn, deactivate circuit 64 and impress a steady state low on line 125. As described above, a low at line 125 prevents oscillation of circuit 62 even with a closure of switch 96. This low is maintained following reopening of switch 186 until capacitor 104 has regained sufficient charge through resistor 106 and switch 90 to return line 110 to a high value and, therefore, re-establish oscillation of circuit 64.

It is apparent that if switch 90 is opened prior to line 110 achieving a high value, that oscillation of network 64 is prevented, and the system is completely shut down. Conversely, if switch 90 is not opened, the circuit will return to its armed state after a delay period. A remotely derived momentary closure of switch 186 would therefore allow the operator to gain entry through door 12 without setting off alarm unit 10 and with the system automatically becoming re-armed or completely shut down, depending upon operator selection of the state of arm switch 90 after entry is accomplished. Numerous techniques are available for remotely effecting the closing of switch 186, for instance, the switch may be present in the circuit as a reed switch as described at 44 in conjunction with FIGS. 2 and 3. By accurately positioning a permanent magnet with respect to the switch, it will be remotely actuated to provide a disarm service. This positioning may, for instance, be made at the surface of door 12 opposite that upon which unit 10 is mounted (FIG. 1).

Figure 6:
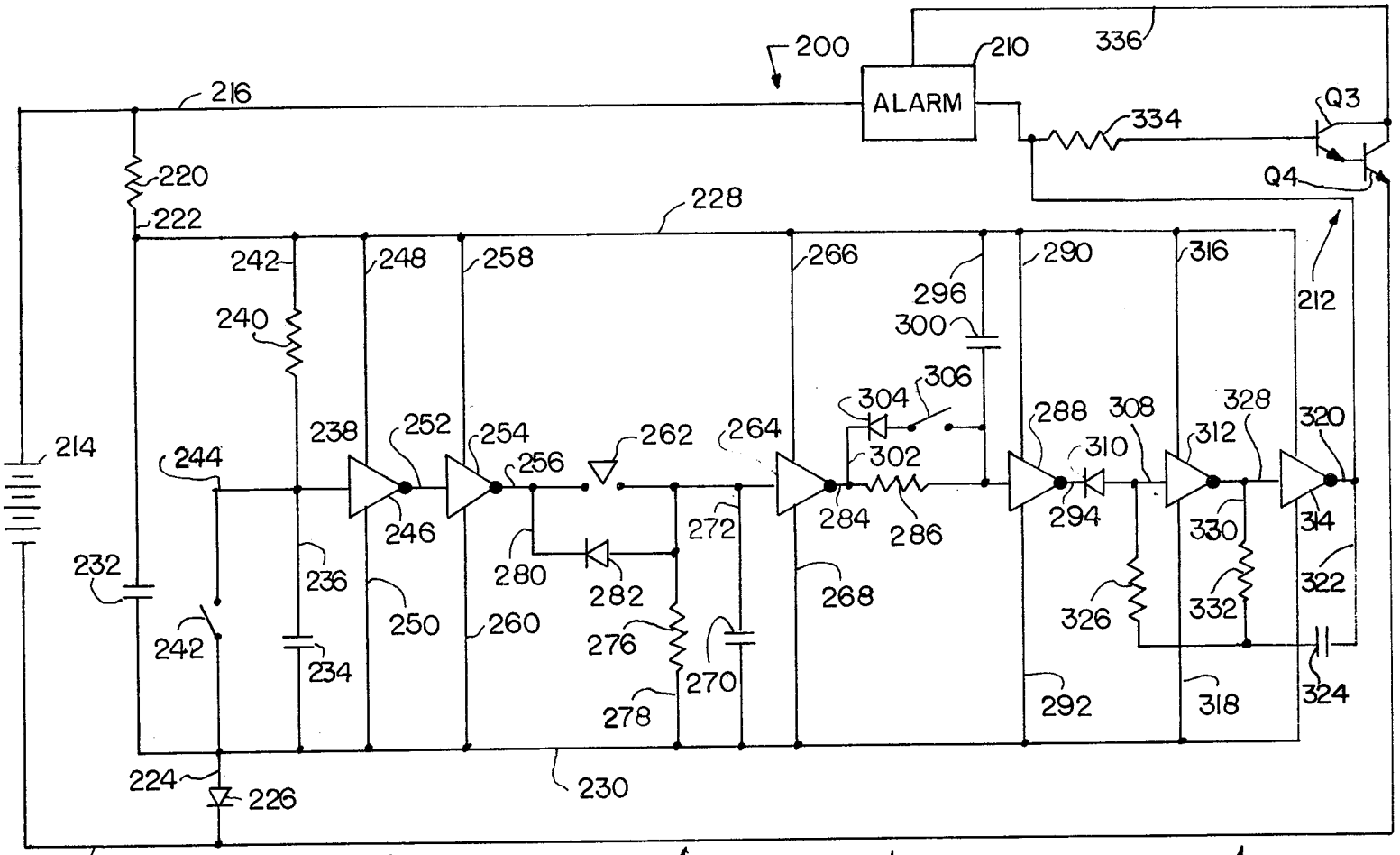
FIG. 6 is a schematic drawing of the logic circuit of another embodiment of the invention.

Turning to FIG. 6, a circuit intended for incorporation within unit 10 and operable in complement with sensor assembly 22 is revealed. This circuit is preferred for embodiments wherein the sensing and alarm system is utilized in homes, apartments and the like wherein an optional alarm delay feature as well as alarm state termination features more rapid in nature may be desired. Circuit 200 generally includes a first or initial timing or delay circuit 202; two additional timing networks 204 and 206; an oscillator network 208; a "buzzer" type alarm or the like 210, and a driver arrangement for the latter 212. Inverter gates formed of COS/MOS circuits are utilized in developing the logic to be described, such circuits generally consisting of one p-channel and one n-channel enhancement-type MOS transistor which are combined to provide conventional inverter logic. As noted earlier, such gates exhibit very little power drain when the circuit is in a quiescent state, thereby contributing one facet to the noted high efficiency of the circuit of the system. As in the case of the embodiment of FIGS. 4 and 5, the terms "high" or "1" and "low" or "0" are utilized in the description to designate operational states.

Power may be supplied to the circuit 200 from a battery 214 which may be of a typically locally available 9 volt variety. The positive terminal of battery 214 is coupled through line 216 to alarm function 210, while the opposite pole thereof is coupled through line 218 to driver arrangement 212. Connection of the logic components of the circuit from line 216 is provided through resistor 220 present within line 222 and from line 218 through line 224 and diode 226. Line 222, in turn is coupled to logic power line 228, while line 224 is connected to logic power line 230. A capacitor 232 is connected intermediate lines 228 and 230 and this capacitor, operating in conjunction with resistor 220 provides a filtered power level input for the logic components at respective lines 228 and 230. This arrangement is particularly useful in functioning to noise isolate the circuit interrupting character of operation of the alarm device 210 where such device is of the above-described variety which interrupts the circuit within line 216 in the course of providing an audibly perceptive alarm. Resistor 220 also serves a current limiting function. Similarly, diode 226 protects the logic components from an inadvertent assertion of a reverse voltage. For consumer related devices, it may be anticipated as a facet of product design that battery 214 may inadvertently be inserted within the device with an improper reversed orientation.

As in the earlier embodiment, circuit 200 incorporates an initial timing or delay circuit 202 which serves the function of permitting the sensor 22 to achieve a null state and also for permitting the user to, for instance, leave through the door upon which the device is mounted. Circuit 202 includes a capacitor 234 positioned within line 236 which, in turn, extends between line 230 and input line 238, as well as a timing resistor 240 positioned within line 242 between line 228 and line 238. The arm switch in the instant embodiment is shown at 242 positioned within line 244 and coupled in shunt relationship across capacitor 234 between lines 238 and 230. Accordingly, with the opening of switch 242, timing circuit 202 is activated to commence a voltage buildup at line 238 toward a "1" level, which signal is introduced to the input of inverter gate 246. Coupled in power supply relationship to lines 228 and 230 through respective lines 248 and 250, gate 246 may be a "C-MOS" model CD 4049 device marketed by Radio Corporation of America. The gate exhibits a threshold voltage characteristic such that upon the occurrence of a "1" value at its input line 238, the output thereof at line 252 converts from that "1" to a "0" level. Generally, the threshold characteristic of this and the remaining gates within circuit 200 are such that conversion from high to low values selectively occurs at a voltage level of from one-third or two-thirds of the voltage applied thereacross as through lines 248 and 250. The resistance and capacitance values at circuit 202 are such as to effect the conversion at gate 246 following about a thirty-second delay from the opening switch 242. The "0" "arm" signal level at line 252 is, in turn, introduced to the input of an identical inverter gate 254 which inverts such signal to provide a "1" signal level representing an arm condition signal at the output line 256 thereof. Gate 254 is powered from lines 228 and 230, respectively, through lines 258 and 260. Note that prior to the conversion of line 256 to a high value, its normal status is low.

Line 256 incorporates the inertially responsive sensor switch 22 earlier described as including reed switch 44 and now represented as switch 262. From the opposite side of switch 262, line 256 is directed to the input of another inverter gate 264 powered from lines 228 and 230, respectively, from lines 266 and 268. Coupled between lines 256 and 230, intermediate switch 262 and the input to gate 264, is a timing network 206 including capacitor 270 coupled within line 272. Note additionally, the presence of a resistor 276 connected within line 278. A line 280 incorporating diode 282 connects from line 278 across switch 262 to line 256 as it extends from the output of gate 254.

With the arrangement shown, assuming that sensor switch 262 has been actuated to close, the arm condition signal or "1" level is conveyed across switch 262 to the input of gate 264. Assuming that switch 262 is closed only instantaneously, such interval is adequate to rapidly charge capacitor 270 to a high state, the only limitation to the rate of such charge being the low resistance of gate 254 itself. Normally, capacitor 270 will charge in less than a millisecond. The "1" level thus developed at the input to gate 264, representing a conveyed arm condition signal, converts the normal "0" level thereat to a "1" value, to cause, in turn, the conversion of the output of gate 264 at line 284 from a "1" to a "0" value. Note that the "0" value normally retained at the input of gate 264 is held through resistor 276 in line 278.

The output line 284 of gate 264 extends through resistor 286 to the input of gate 288. Inverter gate 288 is connected to lines 228 and 230 respectively through lines 290 and 292 and provides an output at line 294.

Extending intermediate resistor 286 and the input to gate 288 between lines 284 and 228 is a line 296 incorporating a timing capacitor 300. Also formed within control network 204 is a line 302 extending from the output of gate 264 at line 284 across resistor 286 to line 296. Line 302 incorporates a blocking diode 304 as well as a switch 306. Providing an alarm delay function, switch 306, when closed, serves to effect an instantaneous response of the alarm system to the closure of sensor switch 262. Alternately, when switch 306 is open, the system provides about a ten-second delay between the closure of sensor switch 262 and the sounding of an alarm at alarm device 210.

Looking in more detail at the functions of timing networks 206 and 204 and assuming an arm condition signal at the output of gate 254, a single closure of sensor switch 262 results in timing capacitor 270 charging immediately to a "1" state as was noted previously. In the absence of any additional sensor signals, timing capacitor 270 will proceed to discharge through lines 272, 256, 278 and resistor 276 to again achieve a "0" value after a predetermined amount of time, i.e., about 30 seconds. Any additional sensor closures during that period of time will result in a recharging of capacitor 270 and the "adding on" of 30 seconds more to the presence of a "1" signal at the input to gate 264, that is, assuming that the arm condition signal is still present at the output of gate 254. With the assertion of a conveyed arm condition signal of "1" value at the input to gate 264, the resultant signal value at its output at line 284 is "0". However, prior to the derivation of a "0" value at line 284, that line is at a "1" value, that value being present at the input of gate 288. Additionally, capacitor 300 is discharged at a high level. The corresponding value at output line 294 is a "0" which will be observed to hold oscillator circuit 208 in an inactive condition. Assuming the closure of switch 306, and the presence of a low value at the output line 284 of gate 264, the "1" value at capacitor 300 immediately is dissipated through line 302 to ground through gate 264 and line 268. The resultant instantaneous "0" value at the input to gate 288 is converted to a "1" level at its output line 294 to effect an activation of oscillator circuit 208 and, is consequence, the sounding of an audibly perceptible alarm at device 210.

Thus being charged to achieve a "0" signal level, capacitor 300 then maintains that level until the input of gate 264 reverts to a "0" level as was described previously. The presence of a "0" at the input to gate 264 results in a "1" output at line 284 and at that time capacitor 300 will proceed to discharge through lines 296, 284, 266 and resistor 286 to gradually reassume a "1" level. This discharge period will be about equal to the alarm delay period since it incorporates the same components and is selected to be about ten seconds. At the termination of this total interval (the discharging of capacitors 270 and 300), a "1" level is reasserted at the input of inverter gate 288 as at line 284 to convert its output at line 294 to a "0" level. In consequence, the oscillator circuit 208 is deactivated to, in turn, deactivate alarm device 210. As will be noted from the foregoing description, the alarm, after being triggered, will sound for a period of time of at least 40 seconds, (30 seconds from network 206 and 10 seconds from network 204) and will then shut down automatically. This feature is a valuable asset for the condition where a single false signal may be received setting off the alarm with no one present in the home. Since it will shut itself off it will not result in generating extreme aggravation with the "neighbors" or wearing out of the battery when such spurious signals are received. Of course, if additional alarm signals are received, then the alarm will continue to sound for 40 seconds after the last received signal.

Should the operator of the system desire to provide, for instance, a ten-second delay in the activation of alarm device 210 following the tripping or closing of sensor switch 262, switch 306 is set in the open position. Such an arrangement, for example, permits reaccess through the door upon which the unit is mounted and disarming within that ten-second interval, thereby permitting its use without the incorporation of an alarm disabling device mounted externally of the door. With this alarm condition the above-mentioned 40-second period is reduced by the alarm delay period to 30 seconds for a single spurious alarm signal. Assuming that sensor switch 262 has been closed under the above condition, a conveyed arm condition signal is present at the input of gate 264. The resultant "0" level at its output at line 284 does not effect an immediate charge of capacitor 300 to, in turn, immediately cause the assertion of a "0" signal level at the input to gate 288. Under the noted delay condition, capacitor 300 now is required to charge through resistor 286 and gate 264 through line 268 to ground. The time constant for these components is arranged, for example, to require about ten seconds to provide for the development of a "0" level signal at the input to gate 288. At the termination of such interval, gate 288 inverts the input "0" level signal thereat to a "1" value at its output line 294 to commence activation of the alarm.

Assuming this feature is being used to enter the door upon which the unit is mounted, within the noted ten-second delay interval, the operator closes switch 242 to effect the shunting of capacitor 234, and, in turn, impose a "0" level at input line 238 of gate 246. The output of gate 246 reverts to a "1" level at line 252, which is introduced to gate 254 to effect a "0" signal level at its output at line 256. This "0" level at line 256 causes the immediate discharge of capacitor 270 through lines 272, 256, 280, diode 282, gate 254 and line 260 to ground. A "0" input signal level thereby is presented at the input to gate 264 which is converted to a "1" level at its output at line 284. As a consequence, capacitor 300 is prevented from any further charge to ground and the "1" level is retained at the input to gate 288 to maintain a "0" signal level at its output line 294 and inactivation of oscillator circuit 288. No alarm activation ensues.

Diode 304 serves a particular function under situations wherein switch 242 is closed after an alarm condition has been established with the tripping of switch 262 and the activation of alarm device 210, or at least the development of a "1" condition at the input to gate 264. With the noted closure of switch 242, the output of gate 264 rapidly converts from a "0" to a "1" output level. Capacitor 300 will be at some charge level below a "1"

level effecting the continued "1" (alarm) level output of gate 288 at line 294. This alarm condition will continue, capacitor 300 now being discharged through resistor 286 to effect a continuance of the alarm signal until such time as a "1" value signal level is achieved at the input to gate 288. It may also be noted that diode 282 serves the function of assuring the appropriate discharge of capacitor 270 upon the closing of switch 242, even though sensor switch 262 may be opened or alternately opened and closed during this deactivation procedure.

Another feature of the system resides in a provision that each time sensor switch 262 is closed, capacitor 270 will be charged to derive an enabling or signal conveying "1" level at the input to gate 264, (assuming switch 242 is open). Accordingly, the initial delay imposed from circuit 202 is not interposed following each actuation of switch 262. The system will continue to sound an alarm from device 210 following the initial activation thereof until both timing networks 204 and 206 discharge to the appropriate "0" level for network 206 at the input of gate 264 and then serially the discharge of network 204 to the appropriate "1" level at the input to gate 288.

Additionally, a closure of arm switch 242 at any time prior to the tripping or closing of sensor switch 262 will effect the shutdown of the system. This is realized by virtue of the earlier described imposition of a "1" level at the input to gate 254 and consequent "0" level at the output line 256 thereof.

Looking now to oscillator circuit 208, the input thereto at line 308 is shown coupled with output line 294 through a blocking diode 310. The circuit incorporates two inverter gates 312 and 314 coupled for power input from line 228, respectively, from lines 316 and the extension of line 228 and to opposite power line 230, respectively, from line 318 and the extension of line 230. The COS/MOS gates 312 and 314 provide the above-noted conventional inverter logic, a high or low value applied at their inputs, respectively, deriving a low or high value at their outputs. The output at line 320 of gate 314 is connected through line 322, capacitor 324 and a stabilizing resistor 326 to input line 308. A line 328 connects the output of gate 312 with the input of gate 314 and, in turn, is connected with one end of a line 330 incorporating a timing resistor 332, the other end of line 330 connecting to line 322 between capacitor 324 and resistor 326.

The operation of circuit 208 may be described by initially assuming the output of gate 312 at line 328 to be in a "1" state. This "1" condition, applied to the input of gate 314, evolves a "0" output thereof at line 320 which output is recognized at capacitor 324. However, capacitor 324 will be charged from the "1" value at line 328 through line 330 and resistor 332. The time constant involved provides the designated oscillatory period for the circuit. As capacitor 324 thus is charged to a high level, the input to gate 312 correspondingly becomes high, the output of the gate becomes low and the output of gate 314 at line 320 assumes a "1" value. Capacitor 324 then discharges through resistor 332 within line 330. Discharge again takes place over the designated oscillatory period of the circuit. At the termination of such discharge, the voltage level at the input of gate 312 passes the transfer-voltage point thereof, and its output at line 328 reverts to a high state. As a result, the output of gate 314 at line 320 reverts to a "0" value and the oscillatory cycle is reiterated.

Circuit 208, however, is selectively disabled or enabled by virtue of the signal value at output line 294 operating in conjunction with diode 310. For instance, when the signal value at line 294 is "0", the high input through resistor 326 to gate 312 is diverted to ground through diode 310. As a consequence, no oscillation takes place and a "0" level is present at output line 320 of the oscillatory circuit. Conversely, with the assertion of a "1" value at line 294, indicating an alarm condition, diode 310 is back-biased and circuit 208 is permitted to oscillate in the fashion described hereinabove, a "1" value readily being asserted at input line 308 through resistor 326.

The output of astable multivibrator or oscillator circuit 208 is present at line 320 and is directed through resistor 334 to the base of transistor $Q_3$ of Darlington connected drive transistors $Q_3$ and $Q_4$. The drive transistors are forwardly biased to provide a conductive path through alarm device 210 in the presence of a high value at line 320. The Darlington connection will be observed to provide for the connection of the emitter electrode of transistor $Q_3$ to the base of transistor $Q_4$, while the collector electrode of transistor $Q_3$ is coupled to the collector of transistor $Q_4$ in common with line 336. Additionally, the emitter electrode of transistor $Q_4$ is coupled with line 218 to provide a switching function responsive to the logic condition at line 320. Accordingly, in the presence of a "1" logic level at line 294, circuit 208 performs an oscillatory function providing alternate high and low values at line 334 in accordance with a frequency predetermined to elicit maximum human audio response. For instance, a 300 millisecond alternate on-off condition at line 320 is considered appropriate. With each high level at line 320, transistors $Q_3$ and $Q_4$ are forwardly biased to effect the conduction of current through device 210. Conversely, a low value at line 320 turns off transistors $Q_3$ and $Q_4$ to complete the cycle definition. Device 210 may be of a conventional "buzzer" type wherein a component is inductively driven to open and close a circuit and, in turn, drive an audio noise device at a frequency selected to maximize human audio response. Such alarm devices as at 210 are readily available in the market place.

It may be noted that no on-off switch is provided in the circuit inasmuch as it is not required by virtue of the very low standby current demand of the circuit. For instance, during typical use, the standby requirement is about 5 micro-amps.

Since certain changes may be made in the above-described apparatus and system without departing from the scope of the invention herein involved, it is intended that all matter contained in the above description or shown in the accompanying drawings shall be interpreted as illustrative and not in a limiting sense.

I claim:

1. An alarm system comprising:

alarm means drivable from a power supply to provide a perceptible alarm;

means deriving a short, transient sensor signal in response to a sense externally generated phenomena;

arm switch means actuable from a first to a second orientation to enable said system;

first oscillator network means having input and output stages, said input stage being responsive to said arm switch means actuation into said second orientation to derive an output signal oscillating, at a first frequency, between one condition and another at said output stage;

first circuit means having an input for detecting said transient sensor signal and deriving a predetermined input condition in response thereto for a predetermined interval;

second oscillator network means having input and output stages, the said input stage of which is arranged for response to one said output signal condition of said first oscillator network means and to said first circuit means predetermined input condition for deriving an output signal oscillating, at a second frequency, between one condition and another at the said output stage thereof for effecting said driving of said alarm means at said second frequency intermittently at said first frequency; and second circuit means connected between said second oscillator network means output stage and said first circuit means input for effecting the maintenance of said predetermined input condition simultaneously with said derivation of said output signal oscillation at said second frequency.

2. The alarm system of claim 1 in which said alarm is acoustic; said first frequency is lower than said second frequency; and said first and second frequencies are selected for optimized human recognition.

3. The alarm system of claim 1 including:

delay network means, responsive to said arm switch actuation into said second orientation for deriving a select signal condition following a predetermined interval;

said first oscillator network means input stage being responsive only to said select signal condition to derive said first network means output stage signal;

said delay network means being configured to retain said select signal condition for a predetermined interval in response to an actuation of said arm switch means from said second into said first orientation.

4. The alarm system of claim 3 including disarm circuit means coupled with said delay network means and comprising a switch magnetically actuable from a predetermined remote location for removing said delay network means select signal condition upon said magnetic actuation.

5. The alarm system of claim 1 in which said alarm is acoustic; said first frequency is selected in the range of about four to five cycles per second; and said second frequency is selected in the range of about one to four $KH_Z$.

6. The alarm system of claim 1 including a housing arrangeable to physically respond to said externally generated phenomena; and wherein said means deriving a short, transient sensor signal comprises:

a body of predetermined mass;

supporting means for flexibly supporting said body a selected distance from a given position upon said housing and configured to permit said body to move to attain a state of rest at a null position corresponding with a select location on said housing; and switch means having at least two components including a magnetically actuable switching device and a magnet, one of said components being fixedly mounted upon said housing, the other of said components being mounted for movement in correspondence with said movement of said supporting means and body of predetermined mass, said component mountings being arranged to effect a magnetic actuation of said switching device upon movement respectively between said supporting means and said null position select location.

7. The alarm system of claim 1 in which said first circuit means predetermined input condition predetermined interval has an extent equivalent at least to one pulse interval of said first frequency.

8. The alarm system of claim 1 wherein said first circuit means includes a capacitor stage coupled for charging in response to said sensor signal and resistor means coupled in discharge relationship with said capacitor stage for effecting retention of said input condition over said predetermined interval.

9. The alarm system of claim 7 including:

delay network means, responsive to said arm switch actuation into said second orientation for deriving a select signal condition following a predetermined interval;

said first oscillator network means input stage being responsive only to said select signal condition to derive said first network means output stage signal;

said delay network means being configured to retain said select signal condition for a predetermined interval in response to an actuation of said arm switch means from said second into said first orientation.

10. The alarm system of claim 9 in which said alarm is acoustic; said first frequency is selected in the range of about four to five cycles per second; and said second frequency is selected in the range of about one to four $KH_z$.

* * * * *